US009718597B2

(12) United States Patent
Itabashi

(10) Patent No.: US 9,718,597 B2
(45) Date of Patent: Aug. 1, 2017

(54) CUSHION

(71) Applicant: Brother Kogyo Kabushiki Kaisha, Nagoya-shi, Aichi-ken (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/002,459

(22) Filed: Jan. 21, 2016

(65) Prior Publication Data

US 2016/0207686 A1 Jul. 21, 2016

(30) Foreign Application Priority Data

Jan. 21, 2015 (JP) ..... 2015-009243

(51) Int. Cl.
*B65D 81/05* (2006.01)

(52) U.S. Cl.
CPC ..... *B65D 81/05* (2013.01)

(58) Field of Classification Search
CPC .. B65D 81/052; B65D 81/022; B65D 81/051; B65D 81/05
USPC ..... 206/522, 591, 583; 383/3
See application file for complete search history.

(56) References Cited

U.S. PATENT DOCUMENTS 6,629,777 B2 * 10/2003 Tanaka ..... B65D 33/02 206/522
7,297,387 B2 * 11/2007 Koyanagi ..... B29C 66/439 206/484
8,813,961 B2 * 8/2014 Liao ..... B65D 81/052 206/522
2004/0232031 A1 11/2004 Nishi et al.
2005/0109656 A1 * 5/2005 Ishizaki ..... B65D 81/052 206/522
2007/0295633 A1 * 12/2007 Liao ..... B65D 81/052 206/522
2008/0197041 A1 * 8/2008 Jian ..... F16F 9/0418 206/522
2009/0050509 A1 * 2/2009 Liao ..... B65D 81/052 206/522

FOREIGN PATENT DOCUMENTS

JP 2004-338785 A 12/2004

* cited by examiner

*Primary Examiner* — Steven A. Reynolds
(74) *Attorney, Agent, or Firm* — Banner & Witcoff, Ltd.

(57) ABSTRACT

A cushion includes at least one first medium container bag and at least one second medium container bag arranged in a second direction to surround an object and each extending in a first direction and capable of containing a medium that absorbs shock to the object. The at least one first medium container bag includes: a first container having a first area in cross section; and a second container protruding, from an end portion of the first container in the first direction, toward a distal end portion of the at least one first medium container bag in the first direction. The second container has a second area in cross section which is less than the first area. The second container protrudes to a position nearer to the distal end portion than each of the at least one second medium container bag in the first direction.

11 Claims, 11 Drawing Sheets

CUSHION

CROSS REFERENCE TO RELATED APPLICATION

The present application claims priority from Japanese Patent Application No. 2015-009243, which was filed on Jan. 21, 2015, the disclosure of which is herein incorporated by reference in its entirety.

BACKGROUND

Technical Field

The following disclosure relates to a cushion for protecting an object.

Description of the Related Art

There is known a cushion for protecting a process cartridge mountable on and removable from a device body of an electronic-photographic image forming apparatus. One example of the cushion is a cushion including a plurality of medium container bags arranged so as to surround the process cartridge and each containing air. Specifically, when the cushion is torn from a cut formed therein, air comes out of all the medium container bags, allowing a user to easily take the process cartridge out of the cushion.

SUMMARY

In the above-described conventional technique, however, when the process cartridge is taken out of the cushion, air comes out of all the medium container bags. Accordingly, the cushion loses its shock absorbing function, making it impossible to reuse the cushion.

Accordingly, an aspect of the disclosure relates to a cushion enabling an object, such as a process cartridge, to be easily taken out of the cushion and also enabling reuse of the cushion.

In one aspect of the disclosure, a cushion includes: at least one first medium container bag extending in a first direction and capable of containing a medium that absorbs shock to an object; and at least one second medium container bag extending in the first direction and capable of containing the medium. The at least one first medium container bag and the at least one second medium container bag are arranged in a second direction perpendicular to the first direction. The at least one first medium container bag and the at least one second medium container bag are arranged so as to surround the object. The at least one first medium container bag includes: a first container having a first area as a cross-sectional area on a plane perpendicular to the first direction; and a second container protruding, from an end portion of the first container in the first direction, toward a distal end portion of the at least one first medium container bag which is one end portion of the at least one first medium container bag in the first direction, the second container having a second area as a cross-sectional area on the plane perpendicular to the first direction, the second area being less than the first area. The second container protrudes to a position which is located nearer to the distal end portion of the at least one first medium container bag than each of the at least one second medium container bag in the first direction.

In another aspect of the disclosure, a cushion includes: a plurality of first air bags containing air and extending in a first direction, each of the plurality of first air bags including: a first container having a first area as a cross-sectional area on a plane perpendicular to the first direction; and a second container having a second area as a cross-sectional area on the plane perpendicular to the first direction which is less than the first area, the first container and the second container being arranged in the first direction; and a plurality of second air bags containing air and extending in a first direction, the second air bags and the first containers being alternately arranged in a second direction perpendicular to the first direction so as to surround an object, a length of the second air bag in the first direction being equal to a length of the first container of the first air bag in the first direction.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Figure 1:
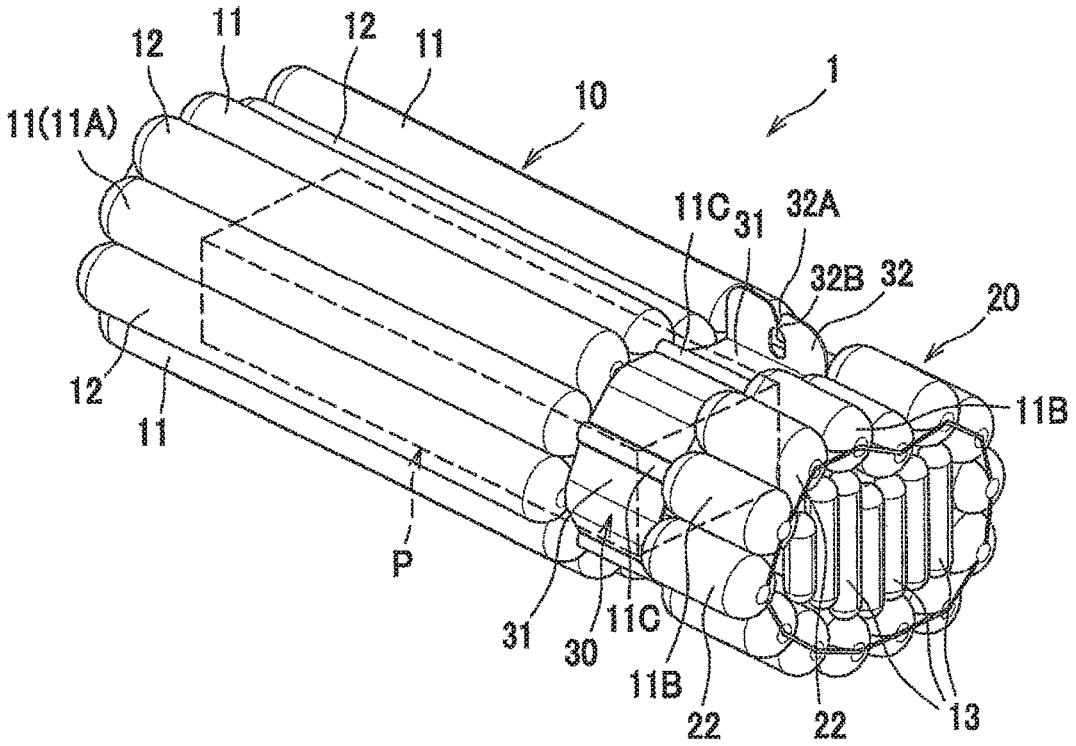
FIG. 1 is a perspective view of a cushion according to one embodiment.

Hereinafter, there will be described one embodiment by reference to the drawings. As illustrated in FIG. 1, a cushion 1 for protecting a process cartridge P is used for image forming apparatuses such as printers and multi-function peripherals. The process cartridge P is one example of an object. The cushion 1 has a substantially hollow circular cylindrical shape for accommodating the process cartridge P therein. The cushion 1 extends in the lengthwise direction of the process cartridge P (hereinafter may be simply referred to as "the lengthwise direction").

Figure 6:
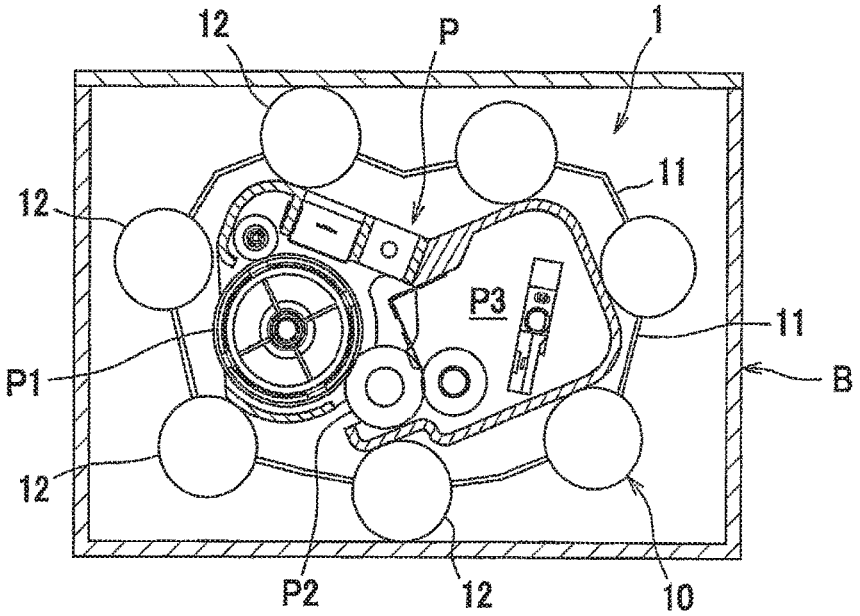
FIG. 6 is a cross-sectional view illustrating a state in which the cushion is in reuse.

It is noted that illustration of the process cartridge P is simplified in FIG. 1 for easy understanding. Here, the process cartridge P has an elongated shape and as illustrated in FIG. 6 includes: a photoconductive drum P1 on which an electrostatic latent image is to be formed; a developing roller P2 configured to supply toner to the electrostatic latent image formed on the photoconductive drum P1; and a toner containing chamber P3 for storing toner.

Returning to FIG. 1, the cushion 1 includes: an object container 10 having a substantially closed-bottom cylindrical shape for accommodating the process cartridge P; a lid 20 having a substantially closed-bottom cylindrical shape and covering an opening of the object container 10; and a coupler 30 which couples the object container 10 and the lid 20 to each other. The substantially closed-bottom cylindrical shape is a shape having a substantially cylindrical portion and a bottom only on one end of the substantially cylindrical portion.

The cushion 1 includes a plurality of air bags 11, 12, 22 arranged cylindrically as one example of a plurality of medium container bags. The object container 10 includes the first air bags 11 and the second air bags 12. Specifically, the object container 10 includes the second air bags 12 and portions of the first air bags 11. Each of the first air bags 11 is one example of a first medium container bag, and each of the second air bags 12 is one example of a second medium container bag. Each of the air bags 11, 12 is filled with air as one example of a medium for absorbing shock to the process cartridge P.

The first air bags 11 and the second air bags 12 are arranged alternately so as to surround the process cartridge P in a cross section perpendicular to the lengthwise direction. In other words, the first air bags 11 and the second air bags 12 are arranged alternately in the widthwise direction of the process cartridge P which is perpendicular to the lengthwise direction. Here, the lengthwise direction is one example of a first direction, and the widthwise direction is one example of a second direction.

Each of the first air bags 11 is elongated in the lengthwise direction and includes: a first large diameter portion 11A as one example of a first container; a second large diameter portion 11B; and a small diameter portion 11C, as one example of a second container, communicating with and connecting between the first large diameter portion 11A and the second large diameter portion 11B. Each of the first large diameter portion 11A and the second large diameter portion 11B has the first area as the area thereof in the cross section perpendicular to the lengthwise direction, i.e., the cross section in the widthwise direction. The small diameter portion 11C has the second area less than the first area, as the area thereof in the cross section perpendicular to the lengthwise direction.

The cross-sectional area of the first large diameter portion 11A may not be equal to that of the second large diameter portion 11B and may be greater or less than that of the second large diameter portion 11B, for example. The second area may be greater than or equal to one eighth of the first area and less than or equal to one fourth of the first area, for example. The second area is preferably less than or equal to one fourth of the first area. Specifically, the first area ranges between 2000 $mm^2$ and 3000 $mm^2$, for example. The second area may range between 250 $mm^2$ and 750 $mm^2$ and may range between 250 $mm^2$ and 500 $mm^2$.

The first large diameter portions 11A partly constitute the object container 10. Each of the first large diameter portions 11A has a substantially hollow circular cylindrical shape and has the length corresponding to the length of the process cartridge P in the lengthwise direction. The small diameter portions 11C partly constitute the coupler 30. Each of the small diameter portions 11C has a substantially cylindrical shape and has the length less than the length of the first large diameter portion 11A in the lengthwise direction. Specifically, each of the small diameter portions 11C has the length corresponding to that of the coupler 30.

The second large diameter portions 11B partly constitute the lid 20. Each of the second large diameter portions 11B has a substantially hollow circular cylindrical shape and has the length less than that of the first large diameter portion 11A in the lengthwise direction. Specifically, each of the second large diameter portions 11B has the length corresponding to that of the lid 20, more specifically, the length substantially equal to that of the small diameter portion 11C.

Each of the second air bags 12 has a substantially hollow circular cylindrical shape extending in the lengthwise direction. Each second air bag 12 has the length substantially equal to that of the first large diameter portion 11A in the lengthwise direction. Each second air bag 12 is disposed such that opposite end portions of the second air bag 12 and opposite end portions of the first large diameter portion 11A are located at substantially the same position in the lengthwise direction. Each second air bag 12 is joined to corresponding adjacent two of the first large diameter portions 11A. Each second air bag 12 is disposed so as to be opposed to a corresponding one of surfaces of the process cartridge P, each of which faces in a direction perpendicular to the lengthwise direction (see FIG. 6). Specifically, as illustrated in FIG. 6, two of the second air bags 12 are arranged so as to be opposed to an upper surface of the process cartridge P in FIG. 6. Likewise, three of the second air bags 12 are arranged so as to be opposed to a lower surface of the process cartridge P, one of the second air bags 12 is disposed so as to be opposed to a left surface of the process cartridge P, and one of the second air bags 12 is disposed so as to be opposed to a right surface of the process cartridge P. The number of the second air bags 12 disposed so as to be opposed to each of the surfaces of the process cartridge P is not limited to each number in the present embodiment and may be any number as long as at least one of the second air bags 12 is disposed so as to be opposed to each surface.

Returning to FIG. 1, a plurality of third air bags 13, not illustrated, are provided integrally at one ends of the air bags 11, 12 which are farther from the coupler 30 then the other ends of the air bags 11, 12. The third air bags 13 are provided so as to fill an opening of the cushion 1 on an opposite side of the air bags 11, 12 from the coupler 30. It is noted that each of the third air bags 13 is one example of a third medium container bag and similar in construction to each of third air bags 13, which will be described below, which partly constitute the lid 20.

The lid 20 includes the plurality of second large diameter portions 11B; the plurality of lid-side second air bags 22 each as another example of the second medium container bag; and the plurality of third air bags 13 each as another example of the third medium container bag. The second large diameter portions 11B and the lid-side second air bags 22 are arranged alternately in a direction in which the plurality of air bags 11, 12 are arranged around the process cartridge P (noted that this direction may be hereinafter referred to as "circumferential direction"). In other words, the second large diameter portions 11B and the lid-side second air bags 22 are arranged cylindrically. Each of the second large diameter portions 11B and corresponding adjacent two of the lid-side second air bags 22 are joined together. Each of the lid-side second air bags 22 has a substantially hollow circular cylindrical shape extending in the lengthwise direction. Each lid-side second air bag 22 has the length substantially equal to that of each second large diameter portion 11B.

Each of the plurality of third air bags 13 has a substantially hollow circular cylindrical shape. The plurality of third air bags 13 are provided so as to fill an opening of the cushion 1 which is located on an opposite side of the second large diameter portions 11B and the lid-side second air bags 22 from the coupler 30. Each of the third air bags 13 has the length appropriate for filling the opening. Each third air bag 13 is joined to corresponding ones of the second large diameter portions 11B and the lid-side second air bags 22.

As described above, the third air bags 13 are provided also on the bottom of the object container 10. Thus, in the present embodiment, the second air bags 12 and/or the third air bags 13 are opposed to each of front, rear, right, left, upper, and lower surfaces of the process cartridge P in the state in which the process cartridge P is contained in the cushion 1.

The coupler 30 connects between the first large diameter portions 11A and end portions of the respective second air bags 12 which are located nearer to the lid 20 in the lengthwise direction. Also, the coupler 30 connects between the second large diameter portions 11B and end portions of the respective lid-side second air bags 22 which are located nearer to the object container 10. Specifically, the coupler 30 has a plurality of sheet-like portions 31 each containing no air, and the plurality of small diameter portions 11C are formed integrally with the sheet-like portions 31.

The small diameter portions 11C protrude toward the lid 20 from ends of the respective first large diameter portions 11A which are nearer to the lid 20 in the lengthwise direction. In other words, in the case where one end portions of the first air bags 11 are defined as distal end portions, specifically, in the case where end portions of the first air bags 11 on which the bottom of the cushion 1 is not provided are defined as the distal end portions, the small diameter portions 11C protrude toward the distal end portions from the ends of the respective first large diameter portions 11A which are nearer to the lid 20 in the lengthwise direction. The small diameter portions 11C are coupled to the ends of the respective first large diameter portions 11A such that air containing portions of the respective small diameter portions 11C and air containing portions of the respective first large diameter portions 11A respectively communicate with each other. Also, each of the small diameter portions 11C protrudes to a position which is nearer in the lengthwise direction to the lid 20 than one of opposite ends of each of the second air bags 12 which is nearer to the lid 20 than the other in the lengthwise direction. In other words, each of the small diameter portions 11C protrudes to a position which is nearer in the lengthwise direction to the distal end of each first air bag 11 than each of the second air bags 12, specifically, a distal end of each second air bag 12 in the lengthwise direction.

The plurality of small diameter portions 11C and the plurality of sheet-like portions 31 are joined together and arranged alternately so as to surround the process cartridge P. One of the plurality of sheet-like portions 31 is formed with an opening tab 32. The one sheet-like portion 31 and the opening tab 32 are formed in one piece.

Figure 2:
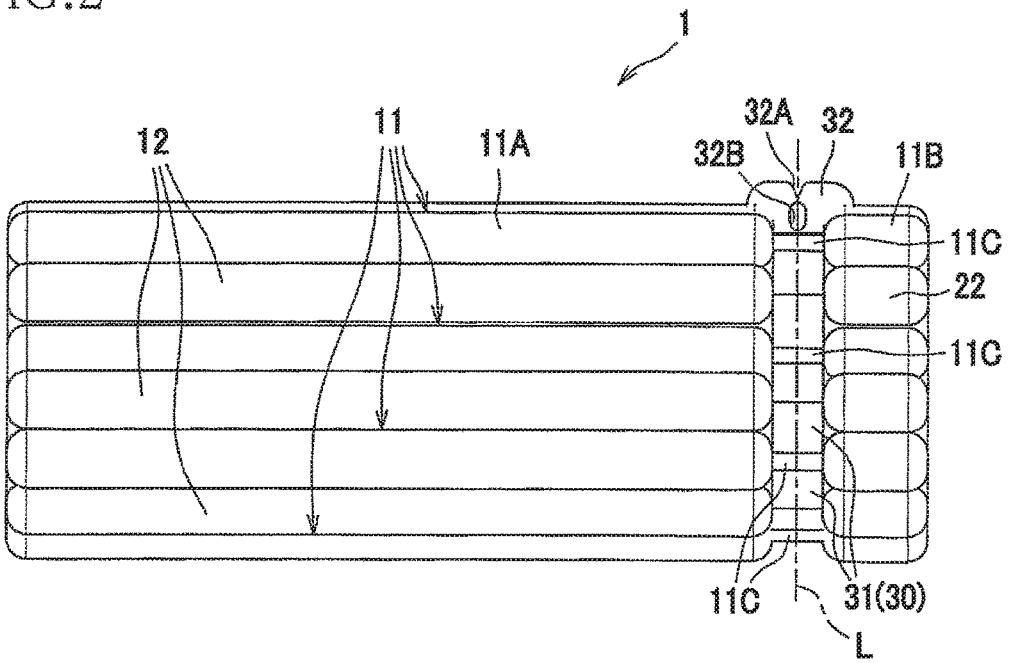
FIG. 2 is a side view of the cushion viewed in its widthwise direction.

As illustrated in FIG. 2, the opening tab 32 is formed for cutting the coupler 30 along a particular line L (see FIG. 2) extending in the circumferential direction. The opening tab 32 protrudes outward from one of the sheet-like portions 31. A distal end portion of the opening tab 32 has a V-shaped cutout 32A at its central portion in the lengthwise direction. The opening tab 32 further has an elongated hole 32B, as one example of a slit, which is formed nearer to the center of the cushion 1 in its cross section (nearer to the sheet-like portions 31) than the cutout 32A. The elongated hole 32B is formed through the opening tab 32 and extends along the particular line L. Each of opposite end portions of the elongated hole 32B has an arc shape.

It is noted that the cutout 32A and the elongated hole 32B are one example of at least one perforation. The particular line L is imaginarily set for the coupler 30, depending upon orientations of the cutout 32A and the elongated hole 32B. The particular line L can be set based on experiments or simulations, for example.

The small diameter portions 11C of the respective first air bags 11 are arranged on the particular line L so as to intersect the particular line L, specifically, be perpendicular to the particular line L. In other words, the small diameter portions 11C are arranged in the coupler 30 such that, when the coupler 30 is torn along the particular line L, a tearing line (see FIG. 3) is formed in the small diameter portions 11C. The end of each of the second air bags 12 which is nearer to the coupler 30 and the end of each of the lid-side second air bags 22 which is nearer to the coupler 30 are spaced apart from the particular line L in the lengthwise direction.

Figure 3:
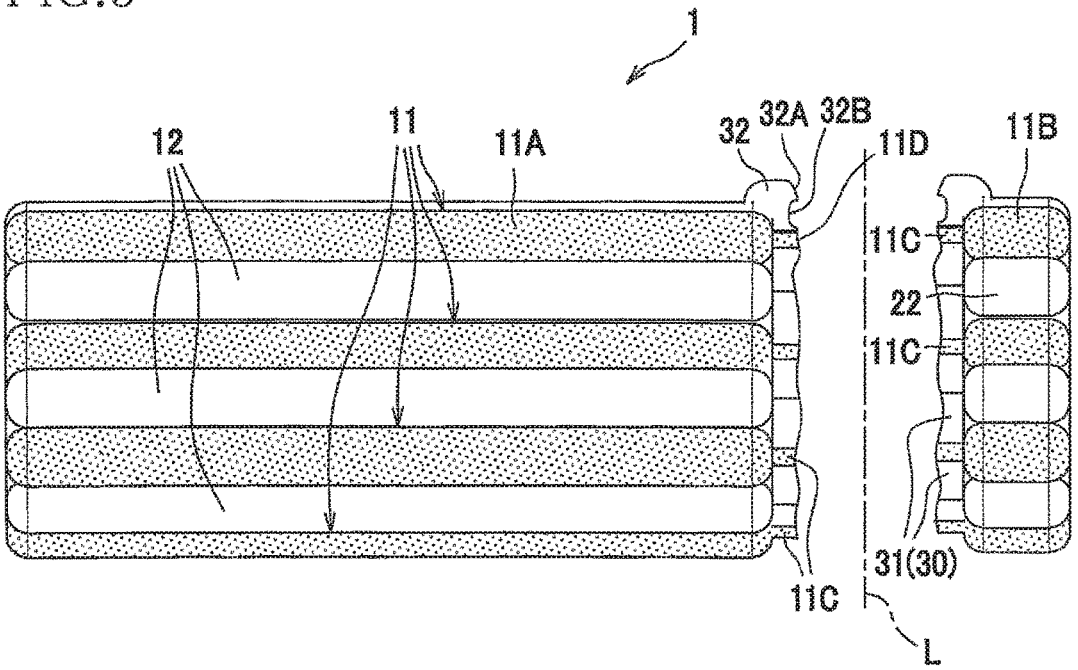
FIG. 3 is a side view of the cushion illustrating a state in which a coupler of the cushion is torn.

Specifically, the ends of each of the second air bags 12 and each of the lid-side second air bags 22 nearer to the coupler 30 are spaced apart from the particular line L at a distance of a particular amount so as not to be located on the tearing line (see FIG. 3). It is noted that the particular amount can be set based on experiments or simulations, for example.

It is noted that the method described in Japanese Patent Application Publication No. 2004-338785 may be employed for a material of the cushion 1 and a method of manufacturing the cushion 1. For example, the cushion 1 may be formed by thermal welding for two flexible plastic films superposed on each other. It is noted that examples of the plastic film include a film in which a nylon layer is sandwiched between a polyethylene layer and a polypropylene layer.

Figure 7:
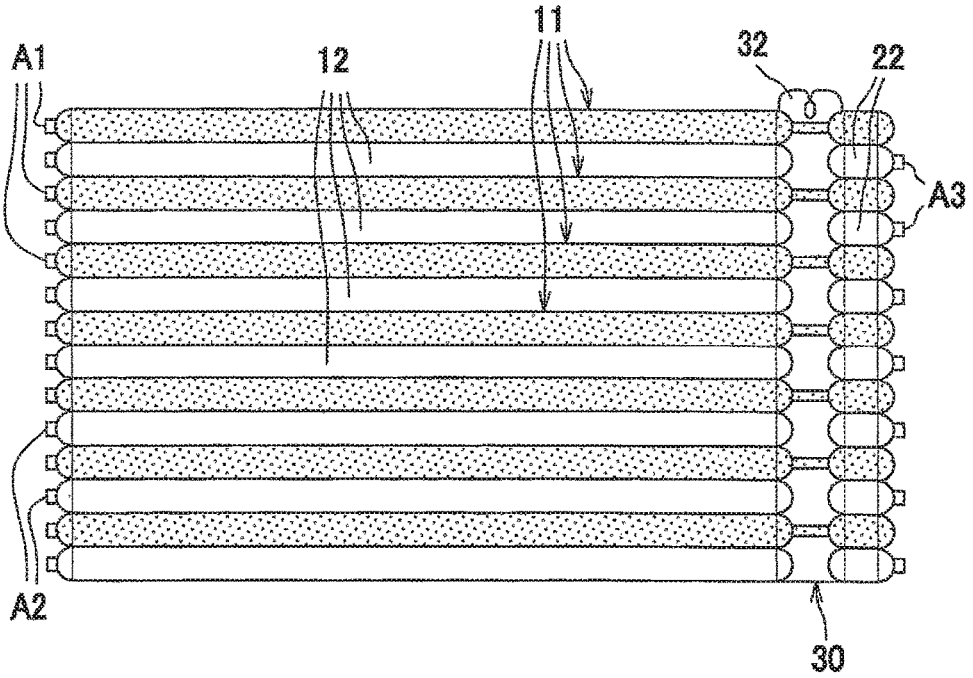
FIG. 7 is a developed view of a cylindrical portion of the cushion.

Specifically, as illustrated in FIG. 7, the two plastic films are superposed on each other, and then thermal welding is carried out for boundaries between the air bags 11, 12, 22, so that the air bags 11, 12, 22 are formed. Thereafter, the two plastic films are bent cylindrically, and thermal welding is carried out for the ends of the respective air bags 11, 12, 22, so that the cylindrical portion of the cushion 1 is formed. It is noted that the third air bags 13 serving as the opposite end surfaces of the cushion 1 can be formed in the same manner.

Air intake openings Al are formed in the ends of the respective first air bags 11 which are farther from the coupler 30 than the other ends of the respective first air bags 11 from the coupler 30. Air is forced into the first air bags 11 through the respective air intake openings A1. Likewise, air intake openings A2 are formed in the ends of the respective second air bags 12 which are farther from the coupler 30 than the other ends of the respective second air bags 12. Air is forced into the second air bags 12 through the respective air intake openings A2. Air intake openings A3 are formed in the ends of the respective lid-side second air bags 22 which are farther from the coupler 30 than the other ends of the respective lid-side second air bags 22. It is noted that a well-known check valve, as described in Japanese Patent Application Publication No. 2004-338785, may be provided near each of the air intake openings A1-A3. Likewise, a plurality of air intake openings are formed in one ends of the respective third air bags 13 serving as the opposite end surfaces of the cushion 1. It is noted that the air intake openings are formed on the same side of the respective third air bags 13.

The process cartridge P is placed into the cushion 1 in the following manner, for example. The process cartridge P is first placed into the cylindrical portion of the cushion 1 containing no air, and then air is forced into the air bags 11, 12, 22 constituting the cylindrical portion. As a result, the air bags 11, 12, 22 are brought into close contact with the process cartridge P.

The third air bags 13 filled with air are then fitted into the opposite ends of the cylindrical portion, and thermal welding is carried out. As a result, the process cartridge P is well placed in the cushion 1.

In the cushion 1, as illustrated in FIGS. 2 and 3, when a user grasps opposite end portions of the opening tab 32 in the lengthwise direction and pulls these opposite end portions away from the cutout 32A, the coupler 30 is torn substantially along the particular line L. As a result, the small diameter portions 11C of the first air bags 11 are torn, so that air release holes 11D (see FIG. 5) for discharging air are formed in the respective small diameter portions 11C. Air in the first air bags 11 (dotted in some figures) is released into the outside through the respective air release holes 11D. Since the second air bags 12 and the lid-side second air bags 22 are not disposed on the particular line L, no air release holes are formed in the second air bags 12 and the lid-side second air bags 22 when the coupler 30 is torn.

Figure 4A:
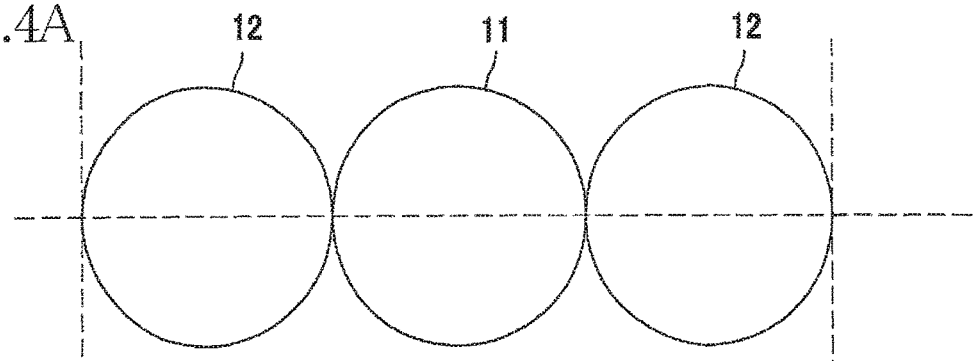
FIG. 4A is an enlarged cross-sectional view illustrating a state in which first air bags are filled with air.
Figure 4B:
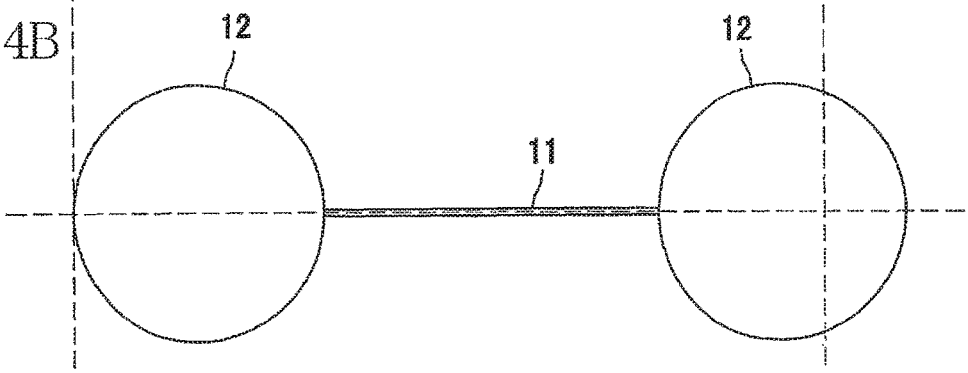
FIG. 4B is an enlarged cross-sectional view illustrating a state in which no air is in the first air bags.
Figure 5:
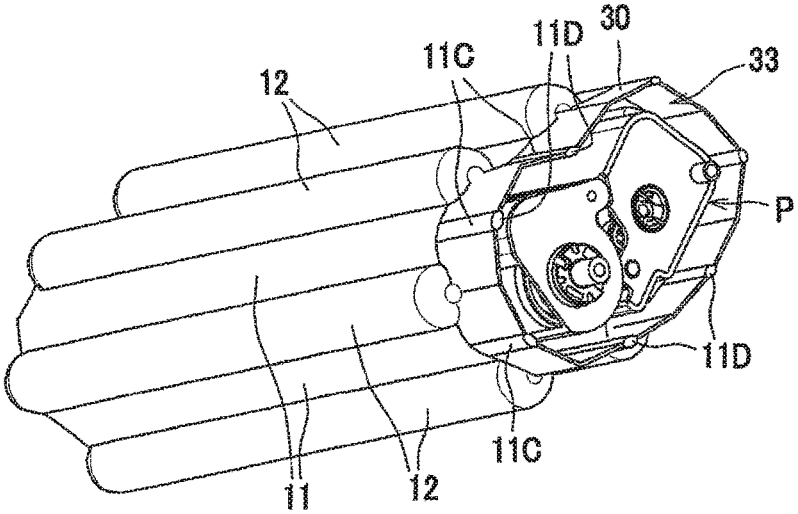
FIG. 5 is a perspective view of an object container viewed from a takeout-opening side, in the state in which the coupler is torn.

When air is released out of the first air bags 11, as illustrated in FIG. 4, the first air bags 11 become flat, resulting in increase in distance between the second air bags 12. As a result, since a force acting on the process cartridge P from the cushion 1 in the widthwise direction becomes weaker, as illustrated in FIG. 5, the process cartridge P can be easily taken out through a takeout opening 33 which is formed by tearing the coupler 30 in the circumferential direction and is one example of a takeout portion.

Air remains in the second air bags 12 and the third air bags 13 also after the process cartridge P is taken out of the cushion 1. Thus, the cushion 1 still has a shock absorbing function, enabling reuse of the cushion 1.

The second air bags 12 or the third air bags 13, containing air even after the process cartridge P is taken out, are arranged so as to be opposed to each of the front, rear, right, left, upper, and lower surfaces of the process cartridge P. Thus, the process cartridge P can be protected in all directions during reuse of the cushion 1. Specifically, as illustrated in FIG. 6, after the object container 10 containing the process cartridge P is contained in a container box B for accommodating the cushion 1, the detached lid 20 is placed into the container box B so as to fill the takeout opening 33. As a result, the second air bags 12 or the third air bags 13 are located between the process cartridge P and inner surfaces of the container box B, enabling the cushion 1 to protect the process cartridge P well in all directions.

It is noted that the length of the process cartridge P in the lengthwise direction is substantially equal to a distance between the bottom of the object container 10 and a position near the coupler 30 in the present embodiment but may be made substantially equal to a distance between the bottom of the object container 10 and the bottom of the lid 20, for example. In this case, the cushion 1 can be attached to the process cartridge P by fitting the object container 10 onto one end of the process cartridge P and fitting the lid 20 onto the other end when the cushion 1 is to be reused. This construction enables the cushion 1 to solely protect the process cartridge P in all directions without using the container box B.

The takeout opening 33 through which the process cartridge P is to be taken out is formed in the coupler 30, i.e., one end of the cushion 1 in the lengthwise direction. This construction can reduce the size of the takeout opening 33 when compared with a construction in which a takeout opening is formed in one end of the cushion 1 in the widthwise direction, for example. This construction prevents the process cartridge P from coming out of the cushion 1 through the takeout opening 33 during reuse of the cushion 1.

The first air bags 11 and the second air bags 12 are alternately arranged. Thus, the second air bags 12 are arranged at substantially regular intervals after air is released from the first air bags 11. This construction enables the second air bags 12 to protect the process cartridge P well.

The small diameter portions 11C of the first air bags 11 with the small cross-sectional area are arranged on the particular line L. Thus, the air release holes 11D can be easily formed in the respective first air bags 11 when compared with a construction in which the first large diameter portions 11A having the large cross-sectional area are arranged on the particular line L, for example.

The plurality of air bags 11, 12 each elongated in the lengthwise direction are arranged in the widthwise direction. Thus, when the process cartridge P is taken out of the cushion 1 through the takeout opening 33 formed in one end of the cushion 1 in the lengthwise direction, no resistance is provided by recesses formed each between corresponding adjacent two of the air bags 11, 12, enabling the process cartridge P to be easily taken out.

While the embodiment has been described above, it is to be understood that the disclosure is not limited to the details of the illustrated embodiment, but may be embodied with various changes and modifications, which may occur to those skilled in the art, without departing from the spirit and scope of the disclosure. For example, the cushion 1 may be modified as follows. In the following explanation, the same reference numerals as used in the above-described embodiment are used to designate the corresponding elements of the following modifications, and an explanation of which is dispensed with. However, reference numerals different from those in the above-described embodiment may be used to designate the corresponding elements of the following modifications when the elements need to be distinguished between the above-described embodiment and the modification or modifications.

Figure 8:
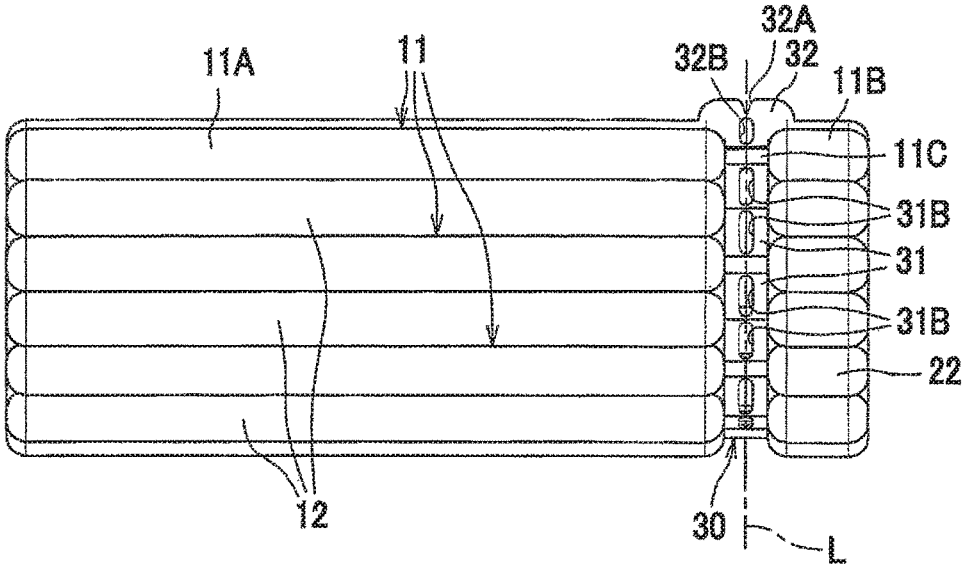
FIG. 8 is a side view of a cushion according to a first modification with a plurality of elongated holes formed in a coupler.

The one cutout 32A and the one elongated hole 32B are employed as the at least one perforation in the above-described embodiment, but the present disclosure is not limited to this configuration. For example, as illustrated in FIG. 8, a plurality of elongated holes 31B may be additionally formed, as the at least one perforation, in the respective sheet-like portions 31 so as to be arranged on the particular line L.

Figure 9:
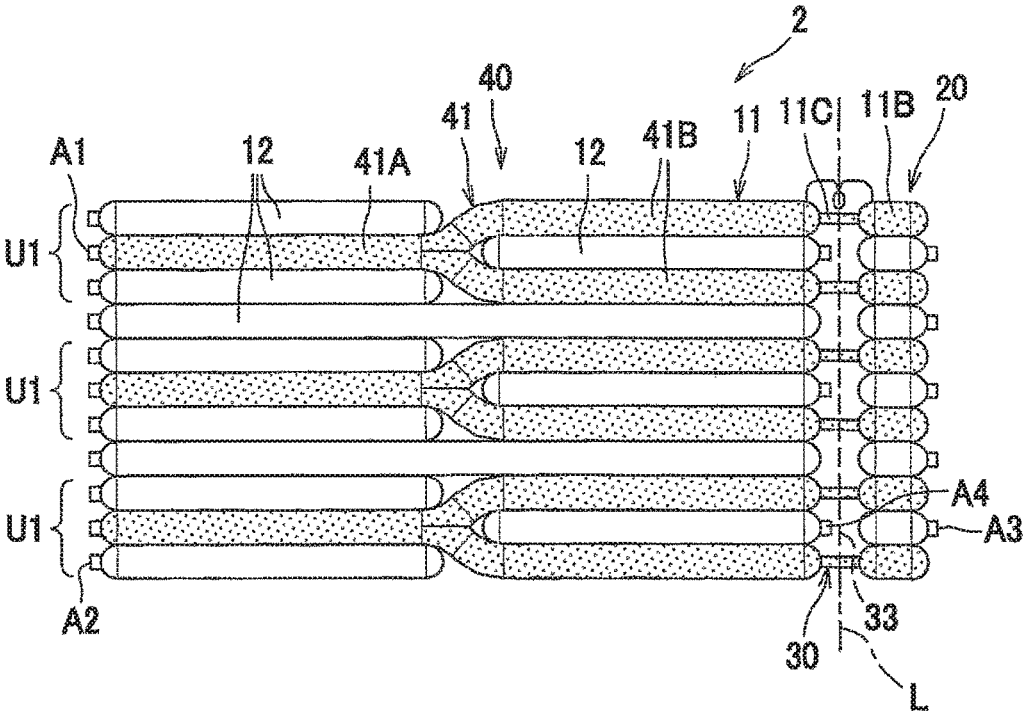
FIG. 9 is a side view of a cushion according to a second modification with each first air bag having a Y shape.

As illustrated in FIG. 9, the object container 10 may be replaced with an object container 40 to more easily take the process cartridge P out of the cushion through the takeout opening 33 formed by tearing the coupler 30. Specifically, FIG. 9 illustrates a cushion 2 including the object container 40 in addition to the lid 20 and the coupler 30 similar in construction to those in the above-described embodiment.

The object container 40 includes: a plurality of first large diameter portions 41 each different in shape from each of the first large diameter portions 11A in the above-described embodiment; the plurality of second air bags 12 similar in construction to those in the above-described embodiment; and the plurality of third air bags 13, not illustrated, similar in construction to those in the above-described embodiment. Each of the first large diameter portions 41 is another example of the first medium container bag, and each of the second air bags 12 is another example of the second medium container bag. Each of the first large diameter portions 41 includes a first portion 41A and two second portions 41B. The first portion 41A extends in the lengthwise direction toward the coupler 30 from one end of the cushion 2 which is farther from the coupler 30 than the other end of the cushion 2 in the lengthwise direction. The two second portions 41B branch off in the widthwise direction from an end of the first portion 41A which is located nearer to the coupler 30 and extend to the coupler 30 in the lengthwise direction.

The second portions 41B are connected to the respective small diameter portions 11C formed in the coupler 30. That is, each of the first air bags 11 in the modification in FIG. 9 includes: the first large diameter portion 41 different in construction from that in the above-described embodiment; and the two small diameter portions 11C and the two second large diameter portions 11B similar in construction to those in the above-described embodiment.

Three second air bags 12 are provided for each of the first air bags 11. Specifically, the three second air bags 12 are constituted by two second air bags 12 provided respectively on opposite sides of a corresponding one of the first portions 41A in the widthwise direction and one second air bag 12 provided between corresponding two of the second portions 41B. Each of the two second air bags 12 provided respectively on the opposite sides of the first portion 41A in the widthwise direction has the length substantially equal to that of the first portion 41A in the lengthwise direction. The two second air bags 12 are adjacent to the respective second portions 41B in the lengthwise direction. The one second air bag 12 provided between the two second portions 41B has the length substantially equal to that of each of the second portions 41B in the lengthwise direction. The one second air bag 12 provided between the two second portions 41B is adjacent to the first portion 41A.

Each of the first air bags 11 and the corresponding three second air bags 12 constitute an air bag unit U1. A plurality of the air bag units U1 are arranged so as to be spaced apart from each other in the widthwise direction. Between each adjacent two of the air bag units U1 is provided one second air bag 12 extending to the coupler 30 from one end of the cushion 2 which is farther from the coupler 30 than the other end of the cushion 2. That is, in this modification in FIG. 9, the total cross-sectional area of end portions of the respective first large diameter portions 41 which are located nearer to the coupler 30 (and which partly constitute the takeout opening 33) is greater than that of end portions of the respective first large diameter portions 41 which are farther from the coupler 30. The total cross-sectional area of end portions of the second air bags 12 which are located farther from the coupler 30 is greater than the total cross-sectional area of end portions of the second air bags 12 which are located nearer to the coupler 30.

With the construction described above, when air is released from the first air bags 11 by tearing the coupler 30, an end portion (a bottom-side portion) of the object container 40 which is farther from the takeout opening 33 is made smaller in size than an end portion of the object container 40 which is nearer to the takeout opening 33, allowing the user to easily take out the process cartridge P. In the case of reuse, many second air bags 12 are left at a bottom portion of the object container 40, whereby the process cartridge P can be reliably held at the bottom portion.

In this modification in FIG. 9, each of the second air bags 12 each disposed between the corresponding two second portions 41B may have an air intake opening A4 at its end located nearer to the coupler 30.

Figure 10:
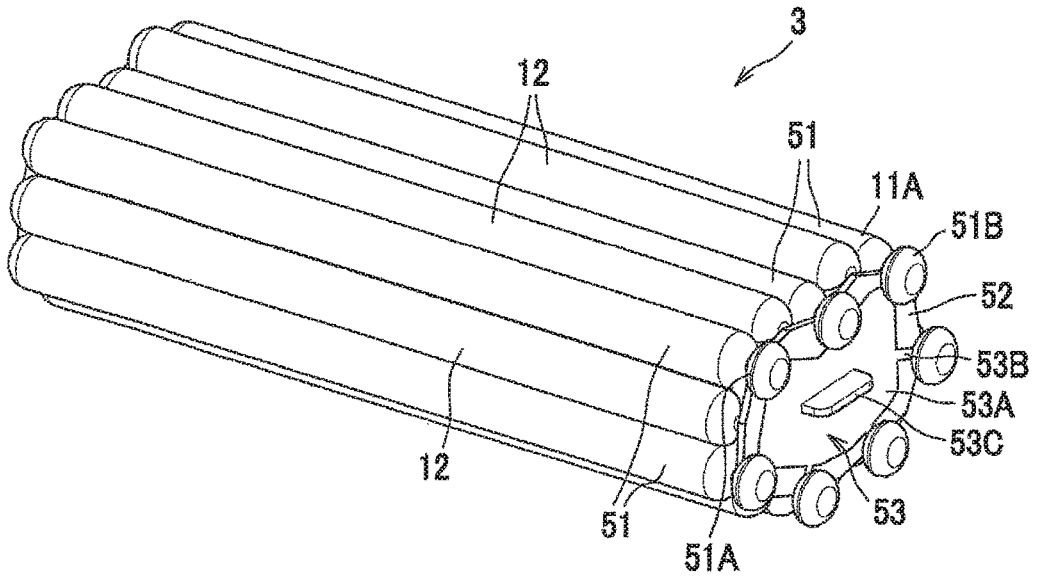
FIG. 10 is a perspective view of a cushion according to a third modification.
Figure 11:
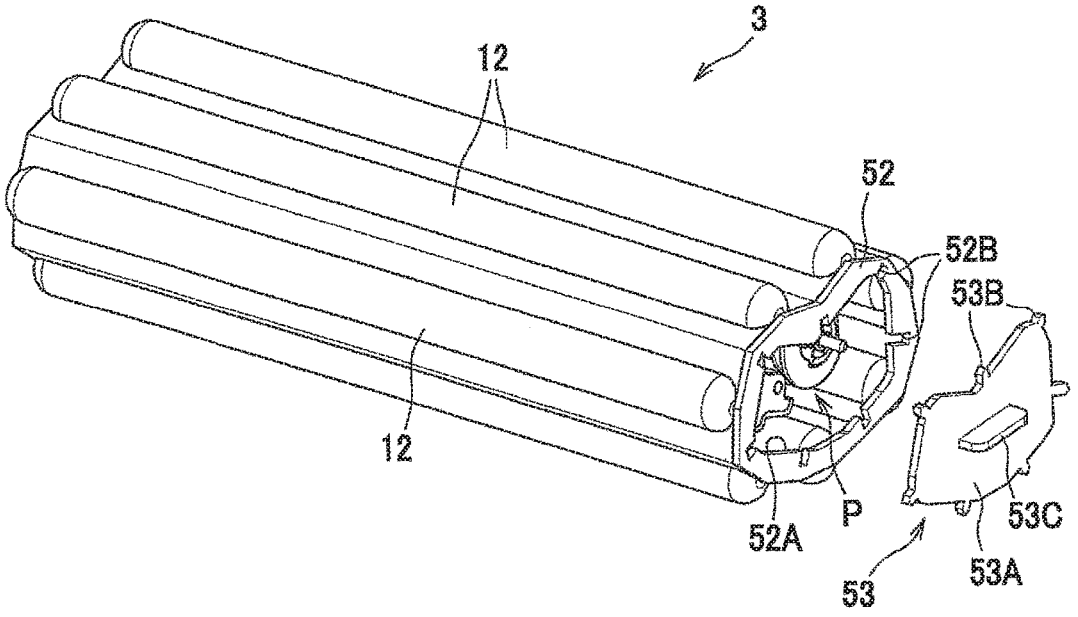
FIG. 11 is a perspective view of the cushion according to the third modification illustrating a state in which a detachable member is removed from a coupling member.

The opening tab 32 is employed as an opening member for forming the air release hole in the first medium container bag in the above-described embodiment, but the present disclosure is not limited to this configuration, and any opening member may be employed. For example, as illustrated in FIGS. 10 and 11, a cushion 3 includes: a coupling member 52 which couples the second air bags 12 to each other; and a detachable member 53 which can be attached to and detached from the coupling member 52. In this configuration, the detachable member 53 may be used as the opening member. It is noted that each of the second air bags 12 is another example of the second medium container bag also in this modification.

Specifically, first air bags 51 and the second air bags 12 are alternately arranged in the circumferential direction as in the above-described embodiment. Also, the cushion 3 has a narrow portion 51A near the coupling member 52 as one example of a recessed portion. Specifically, each of the first air bags 51 includes: the first large diameter portion 11A and the small diameter portion 11C, not illustrated, similar in construction to those in the above-described embodiment; and a third large diameter portion 51B, as one example of a third container, communicating with the small diameter portion 11C and provided on an opposite side of the small diameter portion 11C from the first large diameter portion 11A.

The cross-sectional area of the third large diameter portion 51B is a third area which is greater than the second area. It is noted that the third area may be less than the first area and may be greater than or equal to the first area. The narrow portion 51A is formed by outer surfaces of the first large diameter portions 11A, the small diameter portions 11C, and the third large diameter portion 51B.

The coupling member 52 is shaped like a ring and joined to the second air bags 12. An inner edge of the coupling member 52 defines a takeout opening 52A through which the process cartridge P is taken out. The takeout opening 52A has a plurality of protrusion holding recesses 52B in which engaging protrusions 53B of the detachable member 53 which will be described below are respectively to be fitted.

The detachable member 53 includes: a lid 53A to be fitted in the takeout opening 52A of the coupling member 52; the engaging protrusions 53B, each as one example of a protrusion, projecting outward from an edge of the lid 53A; and a handle 53C projecting outward from a substantially central portion of the lid 53A. The engaging protrusions 53B fitted in the respective protrusion holding recesses 52B are located in the narrow portion 51A of the first air bags 51.

When the user grasping the handle 53C removes the detachable member 53 from the coupling member 52, the engaging protrusions 53B are caught on the narrow portion 51A, which tears the narrow portion 51A, resulting in achievement of the same effects as achieved in the above-described embodiment. It is noted that the engaging protrusions 53B are provided in this modification, but the present disclosure is not limited to this configuration. For example, the detachable member and the first air bags are partly bonded to each other by adhesive. Also in this construction, when the detachable member is detached from the coupling member, the first air bags are torn, and the same effects as achieved in the above-described embodiment can be achieved.

Figure 12:
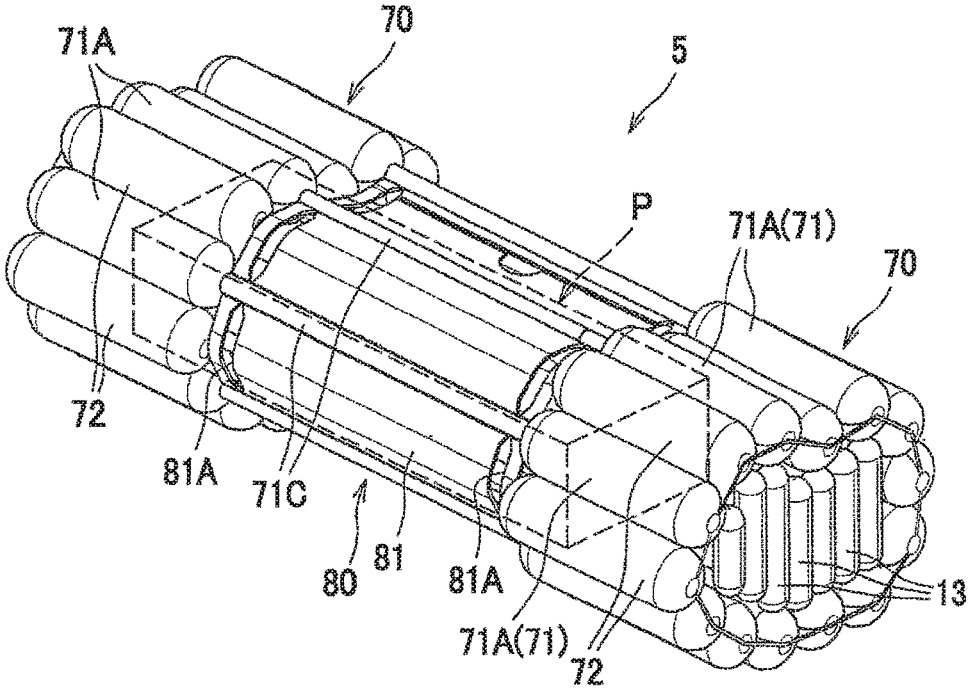
FIG. 12 is a perspective view of a cushion according to a fourth modification.

The cushion 1 for containing the process cartridge P includes the object container 10 having the length substantially equal to that of the process cartridge P in the lengthwise direction in the above-described embodiment, but the present disclosure is not limited to this construction. For example, as illustrated in FIG. 12, the cushion 1 may be replaced with a cushion 5 including: two covering portions 70 for covering opposite end portions of the process cartridge P in the lengthwise direction; and a coupler 80 which couples the covering portions 70 to each other.

Specifically, each of the covering portions 70 includes: a plurality of large diameter portions 71A each shorter in the lengthwise direction than each of the first large diameter portions 11A in the above-described embodiment; a plurality of second air bags 72 each shorter in the lengthwise direction than each of the second air bags 12 in the above-described embodiment; and the plurality of third air bags 13 similar in construction to those in the above-described embodiment. Each of the large diameter portions 71A and the second air bags 72 extends in the lengthwise direction and has the length that is about one third of the length of the process cartridge P in the lengthwise direction.

Each of the large diameter portions 71A of one of the covering portions 70 and a corresponding one of the large diameter portions 71A of the other of the covering portions 70 are coupled to each other by a corresponding one of small diameter portions 71C each longer in the lengthwise direction than each of the small diameter portions 11C in the above-described embodiment. That is, each of first air bags 71 in this modification includes the two large diameter portions 71A and the one small diameter portion 71C.

The coupler 80 couples the two covering portions 70 to each other and includes the small diameter portions 71C and a plurality of sheet-like portions 81 each longer in the lengthwise direction than each of the sheet-like portions 31 in the above-described embodiment. The small diameter portions 71C and the sheet-like portions 81 are alternately arranged in the circumferential direction of the process cartridge P. Elongated holes 81A each extending in the circumferential direction are respectively formed in opposite end portions of a corresponding one of the sheet-like portions 81 in the lengthwise direction. That is, the elongated holes 81A arranged along the circumferential direction are formed in each of opposite end portions of the coupler 80 in the lengthwise direction. The elongated holes 81A are another example of the at least one perforation.

Figure 13:
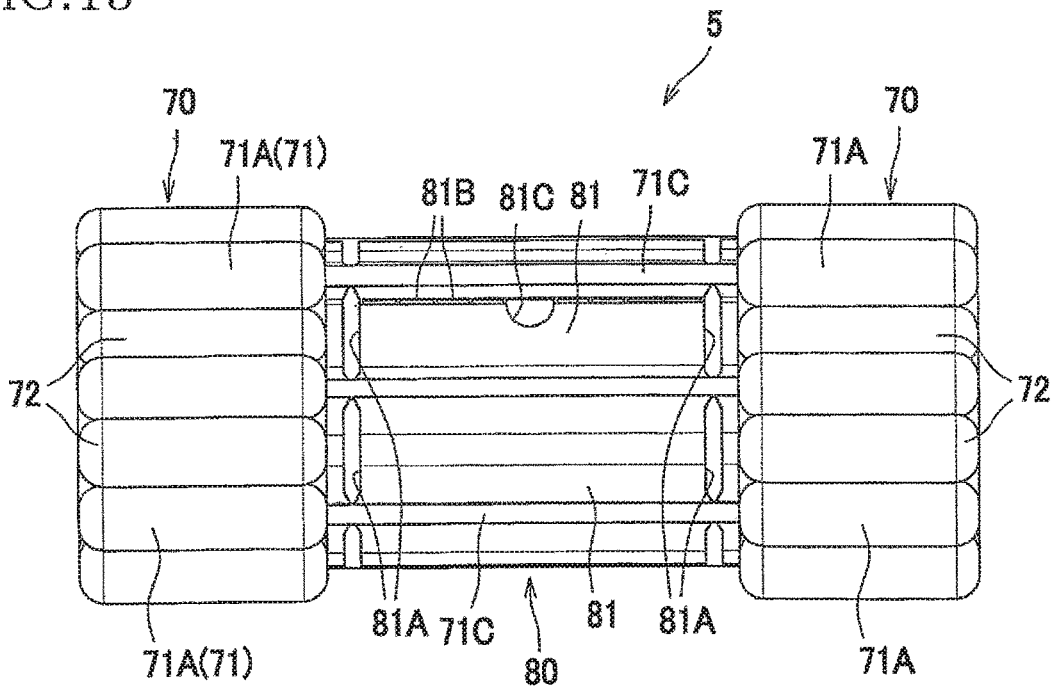
FIG. 13 is a side view of the cushion according to the fourth modification viewed in its widthwise direction.

As illustrated in FIG. 13, a plurality of elongated holes 81B arranged in the lengthwise direction are formed in one end portion of one of the sheet-like portions 81 in the circumferential direction. The plurality of elongated holes 81B are another example of the at least one perforation. An engaging recess 81C is formed in a central portion of the one end portion in the lengthwise direction. The engaging recess 81C is to be held by fingers of the user.

In this modification, when the user holds the engaging recess 81C with his or her fingers and pulls the one end portion of the sheet-like portion 81 in the circumferential direction, the one end portion of the sheet-like portion 81 is torn and detached from the coupler 80 along the plurality of elongated holes 81B arranged in the lengthwise direction. When the user grasps and pulls the one end portion of the sheet-like portion 81, a central portion of the coupler 80 in the lengthwise direction is torn and detached, from the opposite end portions of the coupler 80 in the lengthwise direction, along the plurality of elongated holes 81A that are formed in each of the opposite end portions of the coupler 80 so as to be arranged in the circumferential direction.

Figure 14:
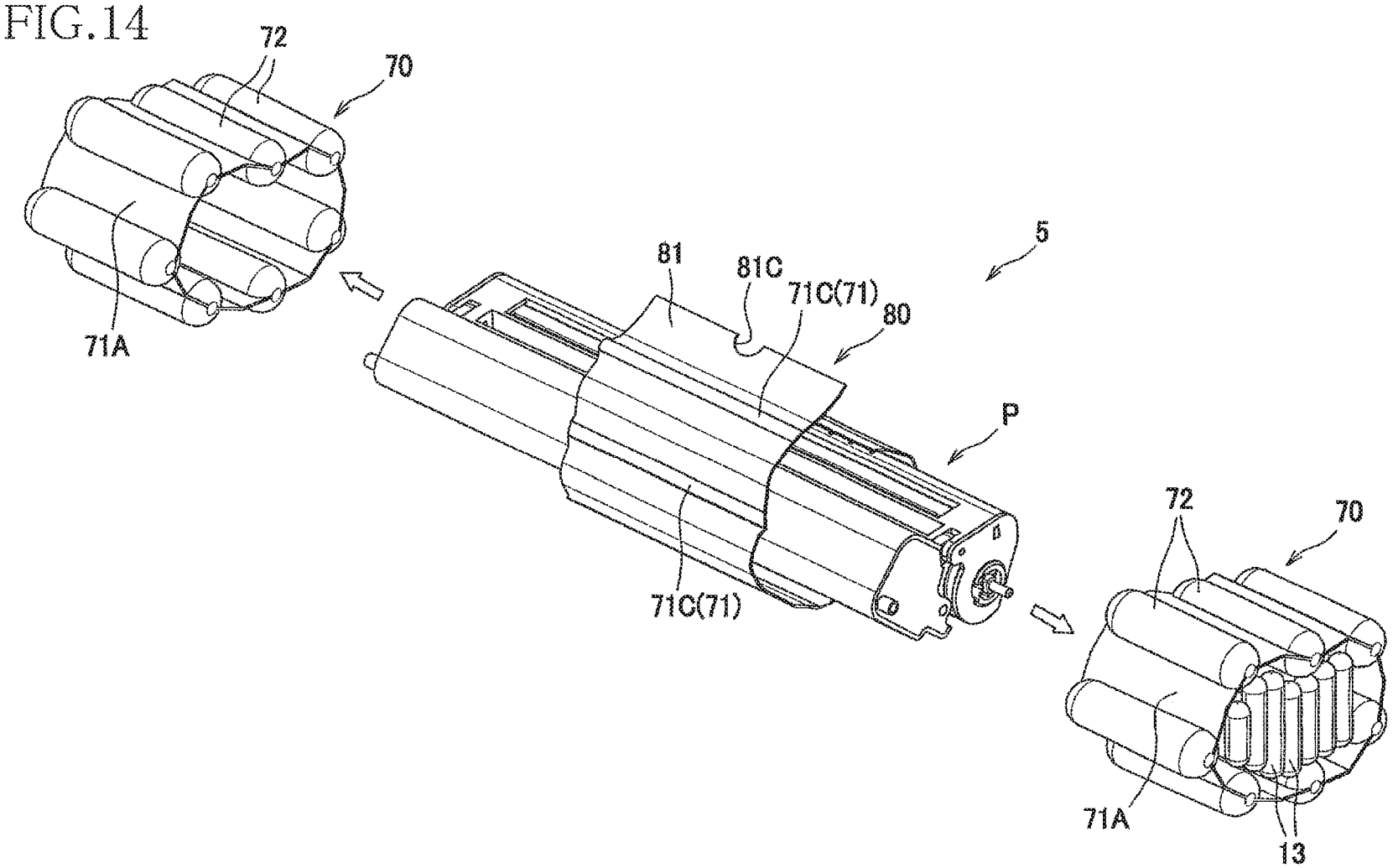
FIG. 14 is a perspective view of the cushion according to the fourth modification which is removed from a process cartridge.

As a result, as illustrated in FIG. 14, each of the opposite end portions of the small diameter portions 71C is torn, so that air comes out of the first air bag 71, resulting in reduced tightening force acting on the process cartridge P from the two covering portions 70. This configuration allows the user to easily remove the covering portions 70 from the process cartridge P. In reuse, the covering portions 70 are fitted onto the respective opposite end portions of the process cartridge P, and then the cushion 5 containing the process cartridge P is placed into a container box.

Figure 15:
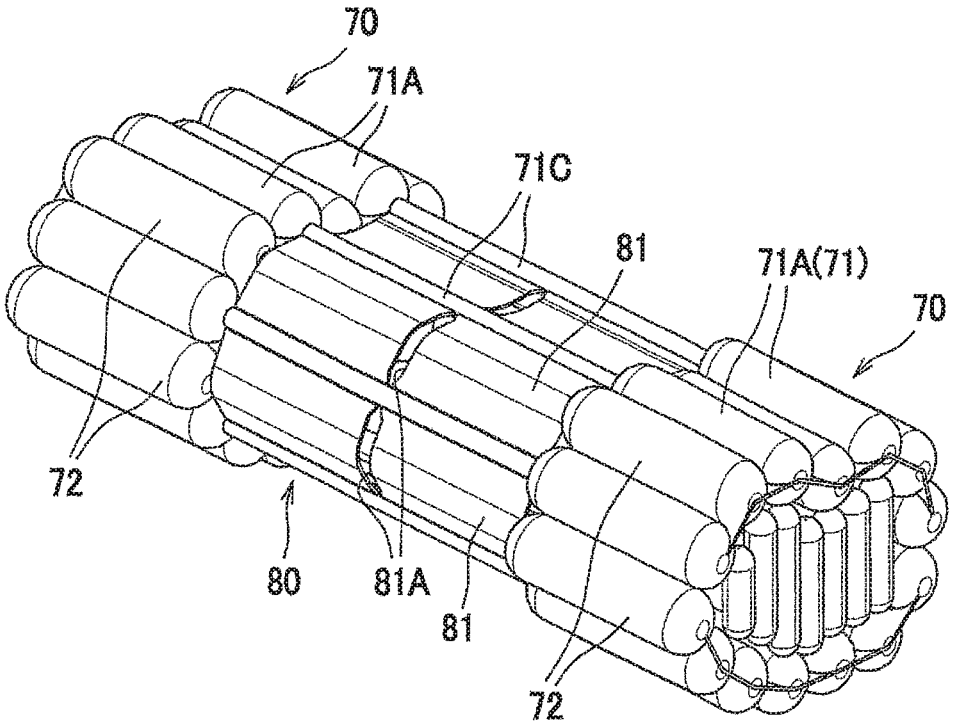
FIG. 15 is a perspective view of a cushion according to a fifth modification.
Figure 16:
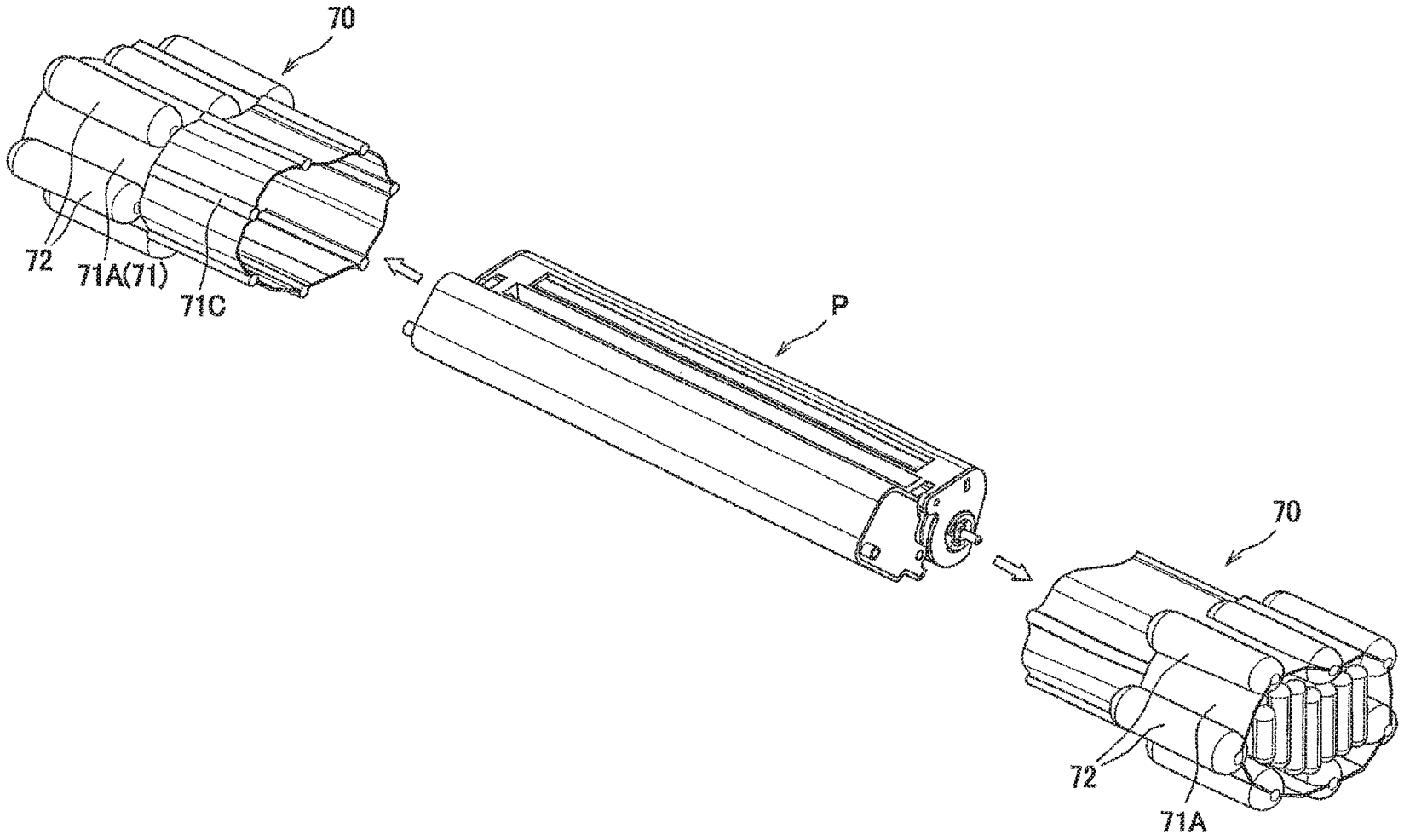
FIG. 16 is a perspective view of the cushion according to the fifth modification which is removed from a process cartridge.

As illustrated in FIG. 15, the plurality of elongated holes 81A arranged in the circumferential direction may be formed only in the central portion of the coupler 80 in the lengthwise direction, specifically, in central portions of the respective sheet-like portions 81 in the lengthwise direction. Also in this construction, the user grasping the opposite end portions of the coupler 80 in the lengthwise direction pulls the coupler 80 to tear the coupler 80 along the plurality of elongated holes 81A, so that the central portions of the respective small diameter portions 71C are torn. As a result, as illustrated in FIG. 16, air comes out of the first air bag 71, resulting in reduced tightening force acting on the process cartridge P from the two covering portions 70, allowing the user to easily remove the covering portions 70 from the process cartridge P.

The process cartridge P is taken as one example of the object in the above-described embodiment, but any object may be employed. The medium is not limited to air, and other kinds of gas such as nitrogen may be employed. The above-described cushion 1 includes the plurality of first air bags 11 and the plurality of second air bags 12, but the present disclosure is not limited to this construction. The cushion 1 may include a single first air bag 11 and the plurality of second air bags 12 and may include the plurality of first air bags 11 and a single second air bag 12.

Figure 17:
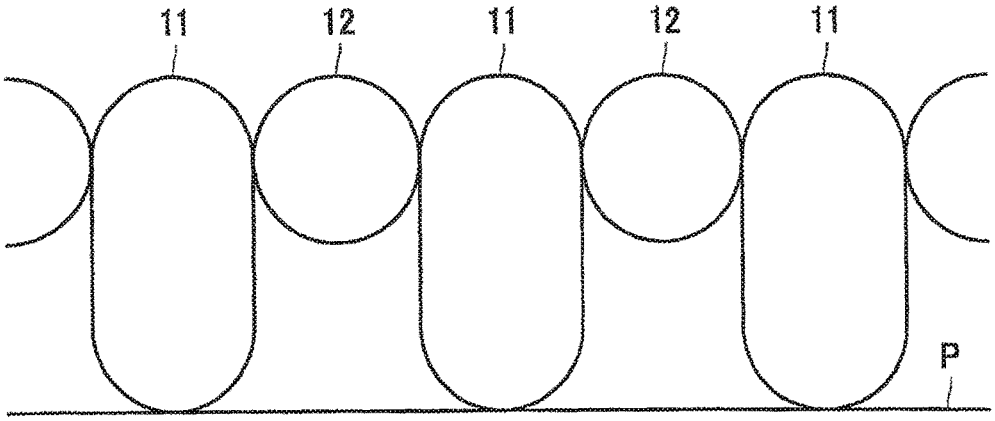
FIG. 17 is a cross-sectional view simply illustrating first air bags in a modification.

In the above-described embodiment, as illustrated in FIG. 4A, each of the first air bags 11 does not protrude to a position inside the corresponding two second air bags 12 respectively located on opposite sides of the first air bag 11, in other words, each of the first air bags 11 does not protrude to a position nearer to the process cartridge P than the corresponding two second air bags 12, but the present disclosure is not limited to this construction. For example, FIG. 17 illustrates a cushion 4 as a modification in which each of the first air bags 11 protrudes to a position nearer to the process cartridge P than each of the second air bags 12. This construction enables the first air bags 11 to reliably hold the process cartridge P in the state in which the first air bags 11 is filled with air. After air is released from the first air bags 11, a large clearance is formed between each of the second air bags 12 and the process cartridge P. Accordingly, a tightening force acting on the process cartridge P from the cushion 4 is considerably small, allowing the user to take the process cartridge P out of the cushion 4 more easily.

Figures 18A, 18B, 18C, 18D, 18E:
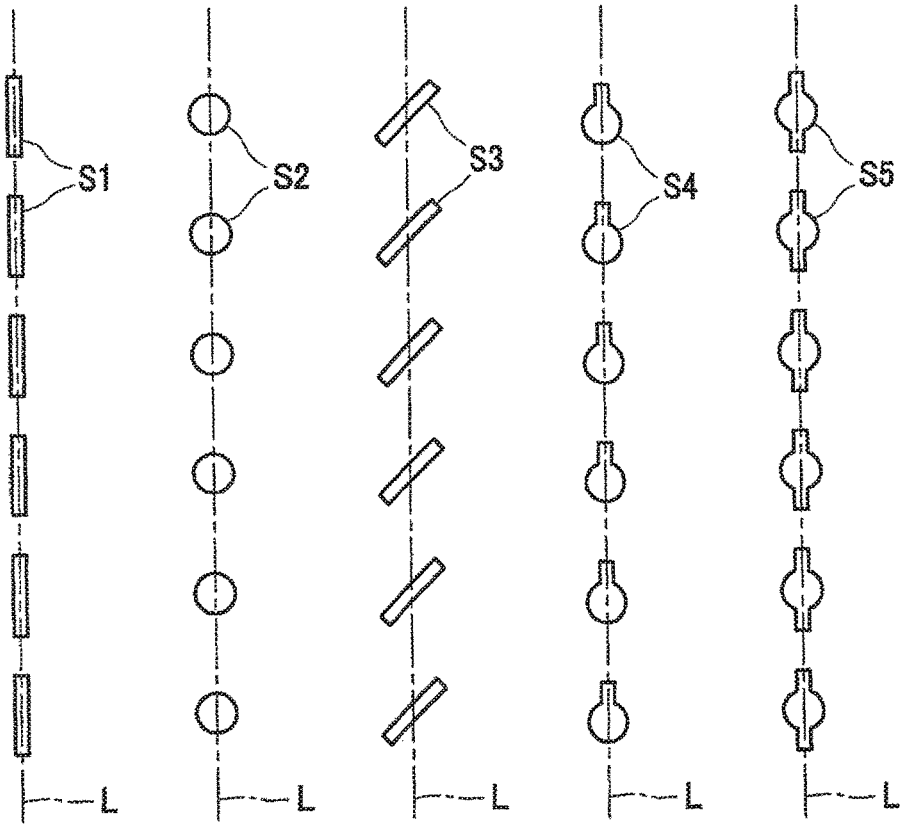
FIGS. 18A through 18E are views simply illustrating slits in modifications.

The elongated hole 32B having the arc-shaped opposite end portions is taken as one example of the slit in the above-described embodiment, but the present disclosure is not limited to this construction. For example, as illustrated in FIG. 18A, the slit may be elongated holes S1 each having a rectangular shape in plan view which extends along the particular line L. As illustrated in FIG. 18B, the slit may be round holes S2. As illustrated in FIG. 18C, the slit may be elongated holes S3 each having a rectangular shape in plan view which is inclined with respect to the particular line L. As illustrated in FIGS. 18D and 18E, the slit may be slits S4, S5 each shaped by combining the round hole S2 in FIG. 18B and the elongated hole S1 in FIG. 18A.

Specifically, the slit S4 is shaped so as to have a round hole and an elongated hole having a rectangular shape in plan view which protrudes outward from a portion of the round hole in a radial direction of the round hole. The slit S5 is shaped so as to have (i) a round hole, (ii) a first elongated hole having a rectangular shape in plan view which protrudes outward from a portion of the round hole in a radial direction of the round hole, and (iii) a second elongated hole having a rectangular shape in plan view which protrudes outward in the radial direction from a portion of the round hole which is the other side of the round hole from the portion from which the first elongated hole protrudes.

It is noted that the at least one perforation is not limited to a hole extending through the coupler. For example, a plurality of portions of the coupler which are weaker than the other portions may be arranged. Alternatively, a portion of the coupler which is weaker than the other portions may be formed so as to extend straight.

What is claimed is:

1. A cushion, comprising:

at least one first medium container bag extending in a first direction and capable of containing a medium that absorbs shock to an object; and at least one second medium container bag extending in the first direction and capable of containing the medium, the at least one first medium container bag and the at least one second medium container bag being arranged in a second direction perpendicular to the first direction, the at least one first medium container bag and the at least one second medium container bag being arranged so as to surround the object, the at least one first medium container bag comprising:

a first container having a first area as a cross-sectional area on a plane perpendicular to the first direction; and a second container protruding, from an end portion of the first container in the first direction, toward a distal end portion of the at least one first medium container bag which is one end portion of the at least one first medium container bag in the first direction, the second container having a second area as a cross-sectional area on the plane perpendicular to the first direction, the second area being less than the first area, the second container protruding to a position which is located nearer to the distal end portion of the at least one first medium container bag than each of the at least one second medium container bag in the first direction, wherein the cushion further comprises a coupler that couples the end portion of the first container in the first direction and an end portion of a corresponding one of the at least one second medium container bag in the first direction, to each other, wherein the coupler is formed with at least one perforation for cutting of the coupler along a particular line, wherein the second container is disposed at a position overlapping the particular line in the first direction, and wherein the end portion of the corresponding one of the at least one second medium container bag in the first direction is disposed at a position not overlapping the particular line in the first direction.

2. The cushion according to claim 1, wherein the at least one first medium container bag and the at least one second medium container bag are alternately arranged in the second direction.

3. The cushion according to claim 1, wherein the at least one perforation is a plurality of slits.

4. The cushion according to claim 1, wherein the second container and the coupler are formed in one piece.

5. The cushion according to claim 1, wherein the second area is less than or equal to one fourth of the first area.

6. A cushion, comprising:

a plurality of first air bags containing air and extending in a first direction, each of the plurality of first air bags comprising:

a first container having a first area as a cross-sectional area on a plane perpendicular to the first direction; and a second container having a second area as a cross-sectional area on the plane perpendicular to the first direction which is less than the first area, the first container and the second container being arranged in the first direction; and a plurality of second air bags containing air and extending in a first direction, the second air bags and the first containers being alternately arranged in a second direction perpendicular to the first direction so as to surround an object, a length of the second air bag in the first direction being equal to a length of the first container of the first air bag in the first direction, wherein each of the plurality of first air bags further comprises a third container having a third area as a cross-sectional area on the plane perpendicular to the first direction which is greater than the second area, wherein the second container is located between the first container and the third container arranged in the first direction, wherein the cushion further comprises a plurality of third air bags containing air and extending in a first direction, the third air bags and the third containers are alternately arranged in the second direction, and the third air bags are spaced apart from the second air bags in the first direction, and a coupler that couples the third air bags with the second air bags, the coupler is formed with at least one perforation for cutting of the coupler on a particular line, wherein the particular line intersects the second containers and does not intersect the first containers, the second air bags and the third air bags.

7. The cushion according to claim 6, wherein a length of the third air bag in the first direction is equal to a length of the third container of the first air bag in the first direction.

8. The cushion according to claim 6, wherein the at least one perforation is a plurality of slits.

9. The cushion according to claim 6, wherein the second area is less than or equal to one fourth of the first area.

10. The cushion according to claim 6, further comprising a plurality of fourth air bags located at an opening which is formed by one ends of the first air bags and one ends of the second air bags, wherein the fourth air bags extend in a direction perpendicular to the first direction.

11. The cushion according to claim 6, further comprising a plurality of fourth air bags located at an opening which is formed by ends of the first air bags and the third air bags, wherein the fourth air bags extend in a direction perpendicular to the first direction.

* * * * *